US005486898A

United States Patent [19]

Fujii et al.

[11] Patent Number: 5,486,898

[45] Date of Patent: Jan. 23, 1996

[54] COLOR IMAGE FORMING APPARATUS WITH PHOTORECEPTOR PROTECTOR

[75] Inventors: Yozo Fujii; Hiroyuki Moriguchi; Yoshikazu Ikunami; Masahiko Matsunawa; Akihiko Tamura; Kazuo Yasuda; Tadashi Miwa; Tatsumi Horiuchi; Tadao Kishimoto; Yoshihide Fujimaki; Hiroyuki Takagiwa; Takashi Tamura, all of Hachioji, Japan

[73] Assignee: Konica Corporation, Tokyo, Japan

[21] Appl. No.: 272,331

[22] Filed: Jul. 8, 1994

[30] Foreign Application Priority Data

| | | | |
|---|---|---|---|
| Jul. 14, 1993 | [JP] | Japan | 5-174570 |
| Nov. 29, 1993 | [JP] | Japan | 5-298361 |
| Nov. 29, 1993 | [JP] | Japan | 5-298367 |

[51] Int. Cl.[6] ..... G03G 15/00

[52] U.S. Cl. ..... 355/200; 355/210; 355/260; 355/326 R

[58] Field of Search ..... 355/200, 204, 355/205, 207, 208, 210, 245, 260, 326 R, 327

[56] References Cited

U.S. PATENT DOCUMENTS

| | | | |
|---|---|---|---|
| 4,866,482 | 9/1989 | Hirasawa et al. | 355/260 |
| 5,134,443 | 7/1992 | Sumi et al. | 355/200 X |
| 5,182,595 | 1/1993 | Fukuchi et al. | 355/200 |
| 5,250,989 | 10/1993 | Morita et al. | 355/210 |
| 5,262,824 | 11/1993 | Morita et al. | 355/200 X |

*Primary Examiner*—Sandra L. Brasé

*Attorney, Agent, or Firm*—Frishauf, Holtz, Goodman, Langer & Chick

[57] ABSTRACT

In a color image forming apparatus, an image retainer, a charger, a plurality of developing devices and a cleaner are made in one unit. The unit is dismountably supported in a housing so that the unit can be moved out from a first position at which the unit is set in the housing to a second position at which jam disposition is conducted. When the unit means is placed at the second position, a part of the apparatus is used to cover the image retaining surface at the transfer section.

25 Claims, 17 Drawing Sheets

COLOR IMAGE FORMING APPARATUS WITH PHOTORECEPTOR PROTECTOR

BACKGROUND OF THE INVENTION

The present invention relates to a color image forming apparatus in which a plurality of developing units are arranged around the circumferential surface of a photoreceptor, and a color toner image is formed when monocolor toner images are superimposed.

Conventionally, an image forming apparatus is well known, in which a side door of the apparatus is opened for jam clearance and maintenance, and a frame accommodating a photoreceptor and developing units is taken out from the apparatus so as to open a conveyance passage of transfer sheets.

Also, what is called a clam-shell type image forming apparatus is well known, in which an upper and a lower portion of the image forming apparatus are separated from each other for the purpose of jam clearance and maintenance, and a conveyance passage of transfer sheets is opened when the upper portion of the image forming apparatus is opened.

However, when a cartridge accommodating the photoreceptor and developing units is removed from the apparatus main body, there is a possibility that the photoreceptor and developing units are stained when operator's hands are contacted with them. Especially when the image forming body is stained, and also when foreign objects are included in the developing units, the quality of formed images is deteriorated.

In the clam-shell type image forming apparatus, the upper portion is separated from the lower portion with respect to a conveyance line to convey transfer sheets. However, in many cases, the photoreceptor is separated from the transfer unit for the purpose of improving the performance of jam clearance. As a result, most of the circumferential surface of the image forming body, which is usually opposed to the transfer unit, is exposed. Therefore, operator's hands tend to come into contact with the circumferential surface of the image forming body, so that the image forming body is stained.

Further, in the clam-shell type color image forming apparatus, a plurality of developing units are assembled to the upper portion of the apparatus. Accordingly, the weight of the upper portion is increased, and the workability is lowered, and further the mechanical strength, rigidity and balance of the overall apparatus are deteriorated. Therefore, vibration is caused in the process of image formation, so that image quality is deteriorated.

SUMMARY OF THE INVENTION

An object of the present invention is to solve the above problems.

Another object of the present invention is to provide a color image forming apparatus in which the conveyance passage of transfer sheets is opened while operator's hands are not contacted with the photoreceptor and developing units, so that jam clearance and maintenance can be easily carried out.

Specifically, the object of the present invention is to provide a color image forming apparatus, which is not a clam-shell type, in which the transfer sheet conveyance passage is widely opened while operator's hands are not contacted with the photoreceptor, so that jam clearance and maintenance can be easily carried out.

The above object can be accomplished by a color image forming apparatus characterized in that: the photoreceptor and developing units are accommodated in a drum frame; the drum frame is movably held with respect to the apparatus main body; the drum frame is moved by a predetermined distance and the transfer sheet conveyance passage is opened in the case of jam clearance and maintenance; and an exposed portion of the photoreceptor is protected by the apparatus main body so that the exposed portion is not substantially contacted by the operator's hand and other objects in the case where the transfer sheet conveyance passage is opened.

It is preferable that the exposed portion of the photoreceptor is covered with a different member in accordance with the movement of the drum frame. It is also preferable that the photoreceptor drum is moved being withdrawn from the transfer means, or alternatively the transfer means is moved being withdrawn from the photoreceptor.

Further, it is preferable that: the photoreceptor is formed into a drum cartridge; the developing cartridge includes developing units containing the developers of Y (yellow), M (magenta) and C (cyan); the developing units are capable of being individually attached to and detached from she drum frame together with a developing unit containing the developer of K (black); and the developing units are inspected and replaced under the condition that the drum frame are drawn out from the apparatus main body.

DESCRIPTION OF THE PREFERRED EMBODIMENT

Figure 1:
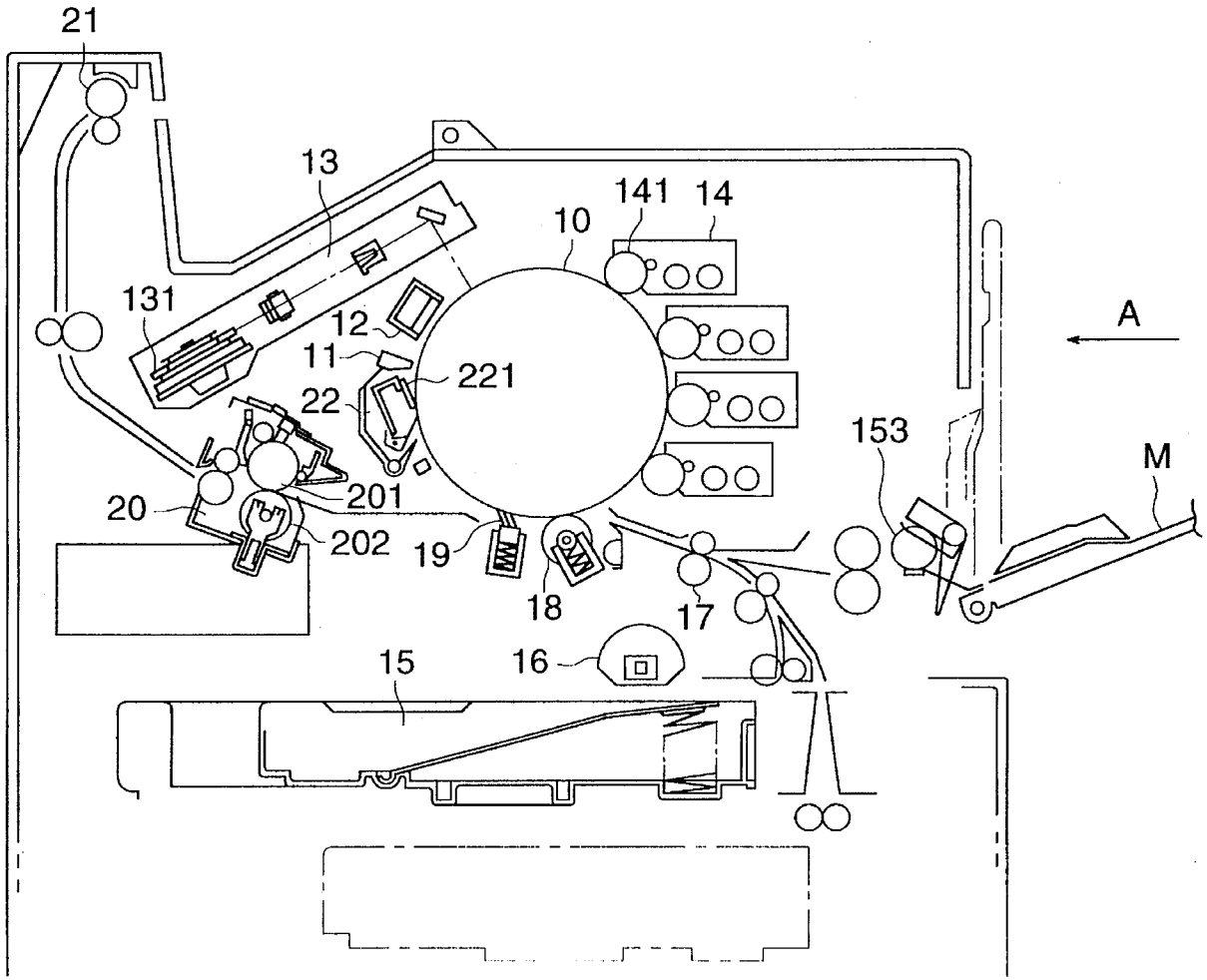
FIG. 1 is a schematic illustration showing the overall arrangement of the color image forming apparatus of the present invention.

With reference to FIGS. 1 to 8, the construction and operation of the color image forming apparatus of the present invention will be explained as follows.

In the drawings, numeral 10 is a photoreceptor drum that is an image carrier. The photoreceptor drum 10 is coated with an OPC photoreceptor and rotated clockwise. In this case, the photoreceptor drum 10 is connected to earth. Numeral 12 is a scorotron charger. The circumferential surface of the photoreceptor drum 10 is given a uniform charge of $V_H$ by the scorotron charger 10, the grid of which is maintained at the electric potential of $V_G$, wherein corona charging is conducted by the grid and corona discharge wire of the scorotron charger 12. Before electric charging is conducted by the scorotron charger 12, the circumferential surface of the photoreceptor drum is electrically discharged when the circumferential surface is exposed to light emitted by PCL11 in which light emitting diodes are used. This discharging operation is conducted for erasing the hysteresis of the photoreceptor.

After the photoreceptor has been uniformly charged, image exposure is conducted by the image exposure means 13 in accordance with image signals. The image exposure means 13 includes a light source (not shown) in which a laser diode is used, rotational polygonal mirror 131, fθ lens, and reflection mirrors 132. A beam of light emitted by the light source passes through the polygonal mirror 131 and fθ lens. Then an optical path of the beam of light is bent by the reflection mirrors 132, so that optical scanning is conducted, and a latent image is formed on the photoreceptor drum 10 when it is rotated (subsidiary scanning). In this example, exposure is conducted on the character portion, so that the electric potential of the character portion becomes a low potential of $V_L$. In this way, a reversal latent image is formed.

Around the photoreceptor drum 10, there are provided developing units 14 respectively including developer composed of carrier and toners of Yellow (Y), magenta (M), cyan (C) and black (K). First of all, development of the first color is conducted by the developing sleeve 141 which includes a magnet and rotates while developer is held on its circumferential surface. Developer includes: carrier particles, the cores of which are made of ferrite, and the cores are coated with insulating resin; and toner particles mainly made of polyester, to which pigment, charging control agent, silica and titanium oxide are added. A layer of developer formed on the developing sleeve 141 is regulated by a layer forming means, so that the thickness of the developer layer is controlled to be 100 to 600 μm. By developing sleeve 141, developer is conveyed to the developing region.

In the developing region, a gap formed between the developing sleeve 141 and photoreceptor drum 10 is larger than the layer thickness of developer, that is, the gap is formed to be 0.2 to 1.0 mm. A bias in which an AC bias of $V_{AC}$ and a DC bias of $V_{DC}$ are superimposed, is impressed in the gap. In this case, the polarities of $V_{DC}$, $V_H$ and toner are the same. Therefore, toner particles which are released from carrier particles by the action of $V_{AC}$, are not deposited on a portion of $V_H$, the electric potential of which is higher than $V_{DC}$, but deposited on a portion of $V_L$, the electric potential of which is lower than $V_{DC}$. In this way, the latent image is made to be visual, that is, reversal development is conducted.

After the first color image has been made to be visual, the image formation process of the second color is started. Therefore, the photoreceptor drum is uniformly charged by the scorotron charger again, and then a latent image is formed by the image exposure means in accordance with the second color image data. At this time, discharging operation is not conducted by PCL11 in order to prevent the toner particles of the first color deposited on the image portion from scattering. Because the toner particles of the first color are scattered when the electric potential is suddenly lowered.

In this way, the overall circumferential surface of the photoreceptor drum 10 is charged to the potential of $V_H$. In a portion on the circumferential surface of the photoreceptor drum 10 where the first color image is not formed, the same latent image as that of the first color is formed and developed. In a portion where the first color image exists and development is conducted again, a latent image of $V_M$ is formed by the action of exposure light which is shielded by the toner of the first color and also by the action of an electric charge of toner. Accordingly, development is conducted in accordance with a potential difference between $V_{DC}$ and $V_M$. When the first color development is conducted on a latent image of $V_L$ in the region where the first and second color images are superimposed, the first and second colors become unbalanced. For this reason, an amount of exposure of the first color is reduced so that an intermediate potential satisfying the following inequality can be obtained.

$$V_H > V_M > V_L$$

With respect to the third and fourth colors, the same image formation process as that of the first color is carried out, and a visual image of four colors can be formed on the circumferential surface of the photoreceptor drum 10.

A recording sheet P conveyed out from the sheet feed cassette 15 by the semicircular roller 16, temporarily stops at a position close to the sheet feed roller 17. The recording sheet P is conveyed to the transfer region by the sheet feed roller 17 in a timed relation of transfer.

In the transfer region, the transfer roller 18 comes into pressure contact with the circumferential surface of the photoreceptor drum 10 in a timed relation, so that the recording sheet P is interposed between the photoreceptor drum 10 and the transfer roller 18, and a multicolor image can be transferred all at once.

Next, the recording sheet P is electrically discharged by the separation brush 19 which has come into pressure contact with the photoreceptor surface. Therefore, the recording sheet P is separated from the circumferential surface of the photoreceptor drum 10 and conveyed to the fixing unit 20. Toner on the recording sheet P is heated by the heat roller 201 and pressed by the pressure roller 202. After that, the recording sheet P is discharged outside the apparatus. In this connection, the transfer roller 18 and separation brush 19 are withdrawn and separated from the circumferential surface of the photoreceptor drum 10 in order to prepare for the next image formation.

After the recording sheet P has been separated from the circumferential surface, the blade 221 of the cleaning unit 22 comes into pressure contact with the photoreceptor drum 10, so that residual toner is removed and cleaned. After that, the photoreceptor drum 10 is discharged by PCL11 and charged by the charger 12. Then the next image formation process is started. In this connection, after the circumferential surface of the photoreceptor has been cleaned, the blade 221 is immediately moved and withdrawn from the circumferential surface of the photoreceptor drum 10.

Figure 2:
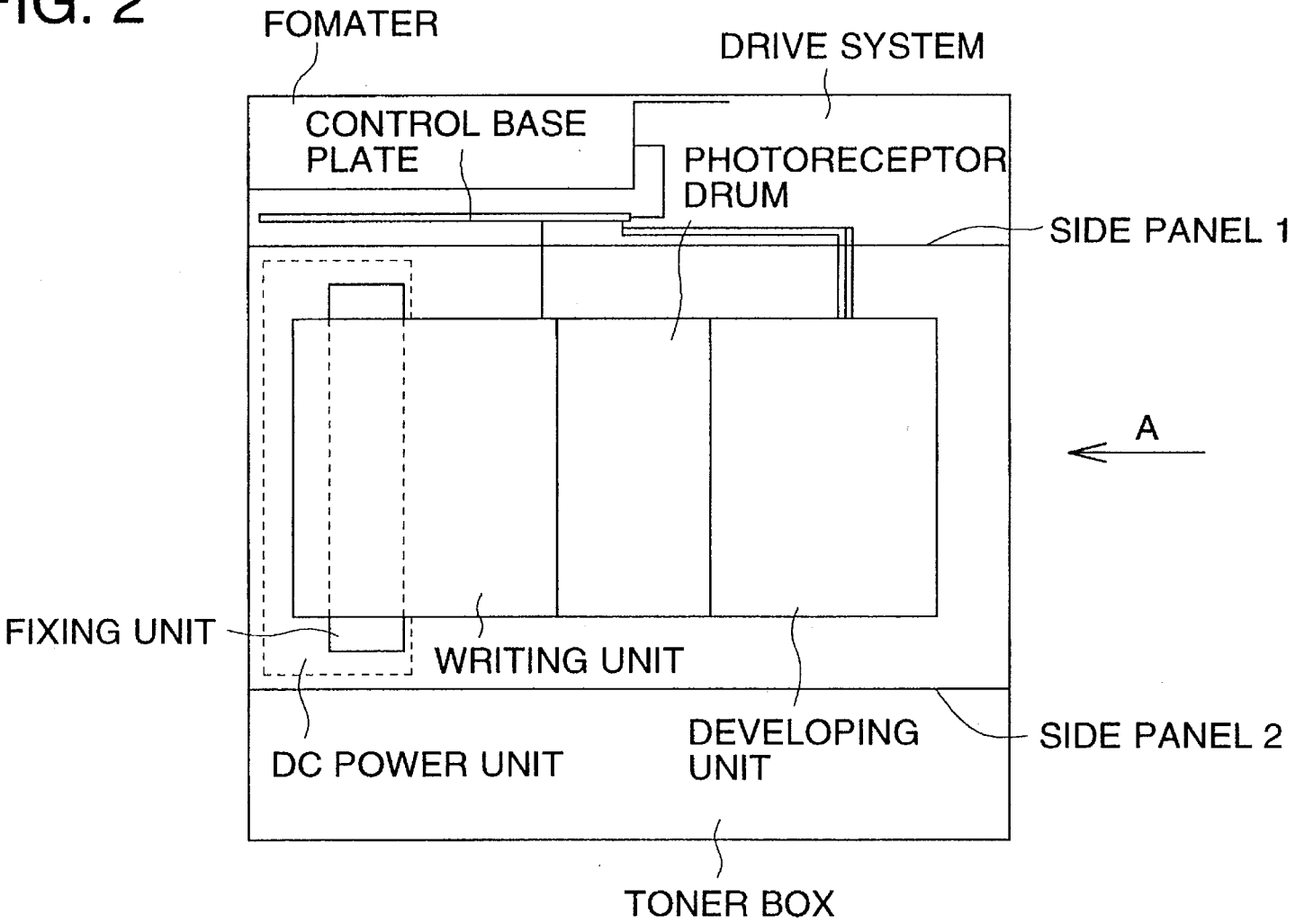
FIG. 2 is a schematic illustration showing a layout of each units in the above apparatus.

FIG. 2 is a plan view showing the layout of each unit composing the apparatus described above. The front of the apparatus is shown by arrow A. In this case, the front of the apparatus corresponds to the side of the operation.

The main body of the apparatus includes a side panel 1 and a side panel 2. Between these two side panels, there are provided a writing unit which is the image exposure means 13, photoreceptor drum 10, developing device having a plurality of developing units 14, fixing units 20, and DC power unit. On the other hand, outside of the side panel 1, there are provided a drive system, formater for decoding the printer command, and control base plate for controlling the operational sequence of the apparatus. Outside of the side panel 2, there is provided a toner box connected with each developing unit 14 in the developing device.

Since the photoreceptor drum 10 and developing units are disposed close to the operational side of the apparatus, they can be easily drawn out to the front of the apparatus. When the upper portion of the apparatus is opened, the drum frame can be drawn out to a drawing position without taking out the photoreceptor drum 10 and developing units from the main body. Therefore, jam clearance can be easily conducted at the transfer position.

In the sheet feed section, jam clearance can be carried out when the sheet feed cassette 15 provided below the photoreceptor drum 10 and developing units is taken out outside. In the sheet discharge section, jam clearance can be carried out when the back side surface of the apparatus is opened.

Function and performance of each unit composing the image forming section of the aforementioned apparatus will be described as follows.

[Photoreceptor]

Figure 3:
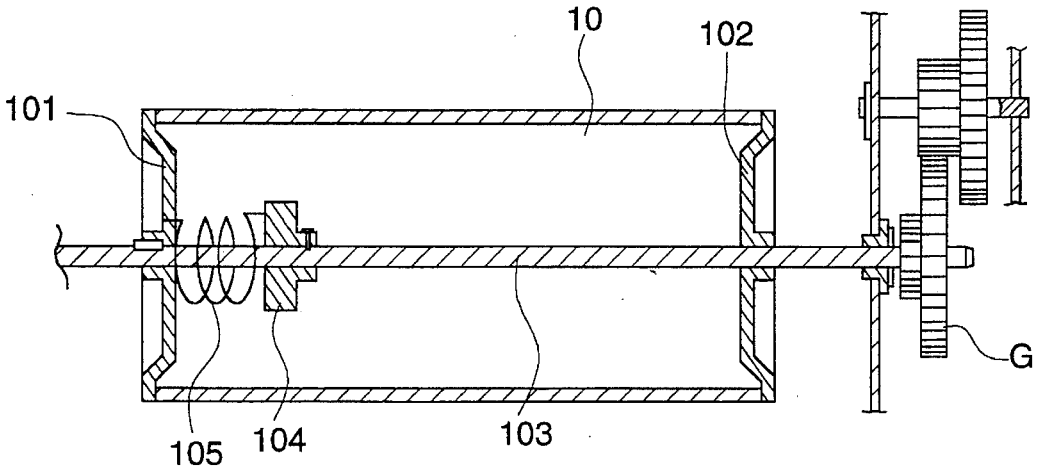
FIG. 3 is a schematic illustration showing an arrangement of drum driving of the photoreceptor drum.

FIG. 3 shows a power transmission means for driving the photoreceptor drum 10. Flanges 101, 102 support the circumferential surface of the drum. Both flanges 101, 102 is capable of being rotated with respect to a drive shaft 103. A fixing member 104 is mounted on the drive shaft 103. A spring member 105 is provided between the fixing member 104 and one 101 of the flanges. In this way, the flange 101 is connected with the drive shaft 103 through the spring member 105. Due to the foregoing construction, can be obtained the same effect as that of a drive system in which the rigidity of the photoreceptor drum 10 and that of the drive shaft 103 are reduced. That is, the natural frequency of the drive system is lowered, so that the drive system can not resonate with the vibration of drive gear G. Due to the foregoing, the fluctuation of rotational speed of the drive shaft 103 can be absorbed by the members of low rigidity. Therefore, the photoreceptor drum 10 can be rotated without causing the fluctuation of the rotational speed.

Since the photoreceptor drum 10 can be stably rotated as described above, the OPC photoreceptor on the circumferential surface of the photoreceptor drum 10 can be uniformly charged by the scorotron charger 12. In the process of charging, the grid voltage is controlled, so that the charging voltage can be stabilized. One example of the specification of the photoreceptor and the charging condition will be described as follows.

Photoreceptor: OPC photoreceptor
Linear speed 100 m/sec
Negative charging

Charging condition: Charging wire: Platinum wire (Clad or alloy)

$V_H$–850 V, $V_L$–50 V

[Image Exposure]

Figure 4:
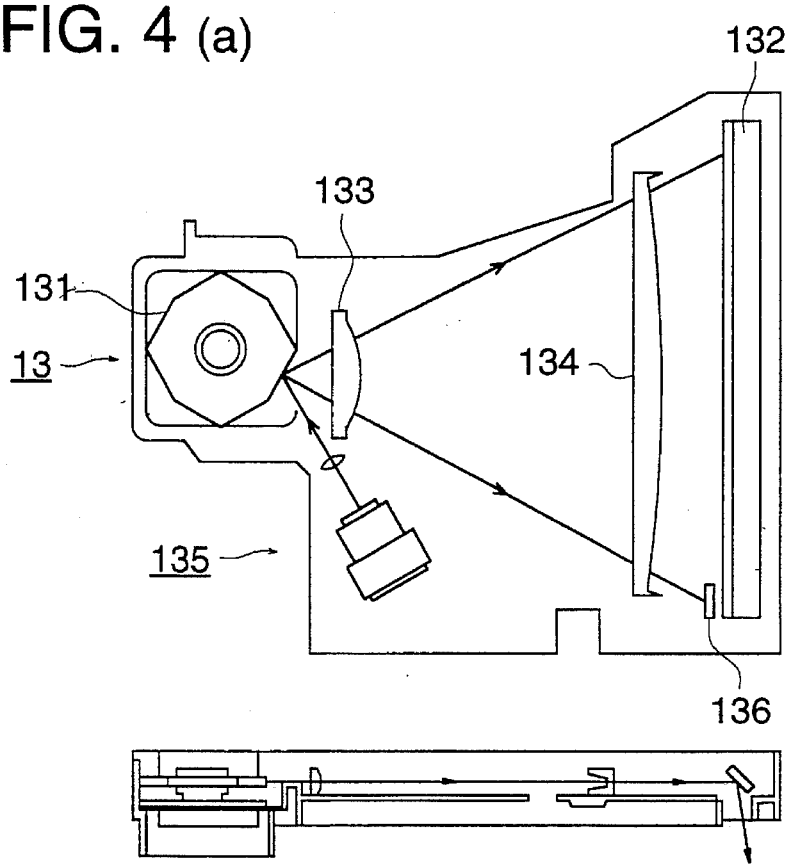
FIGS. 4(*a*) and 4(*b*) are schematic illustration showing an optical system of the image exposure means.
Figure 4:
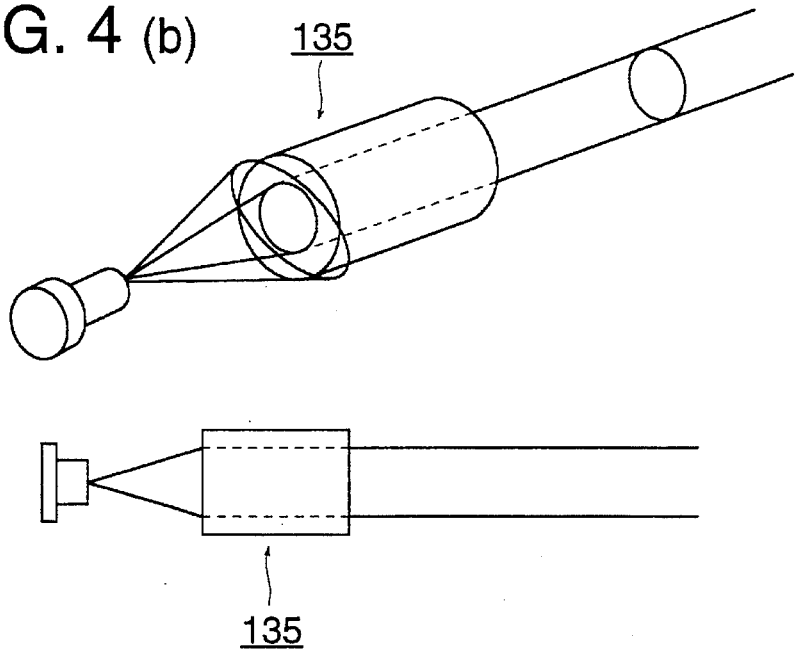

FIG. 4(*a*) includes a plan and a side view of the layout of the image exposure means 13. FIG. 4(*b*) is a schematic illustration of the semiconductor laser unit 135 used for the image exposure means 13.

After the OPC photoreceptor on the circumferential surface of the photoreceptor drum 10 has been negatively charged by the charger 12, it is exposed to light emitted by the semiconductor laser unit 135 of the image exposure means 13, so that an electrostatic latent image is formed.

Image data is sent from the formater to the laser diode (LD) modulation circuit. When the LD of the semiconductor laser unit 135 emits a beam of light in accordance with the modulated image signal, the scanning lines of the beam are synchronized by the beam index 136 through the mirror 137, and then the beam of light is projected onto the polygonal mirror 131.

The beam of light is reflected by the polygonal surfaces of the polygonal mirror 131 so that scanning is conducted. A beam configuration of the scanning light is corrected by the fθ lens 133 and the cylindrical lens 134. Then the scanning light conducts primary scanning on the photoreceptor through the reflection mirror 132. In this way, an electrostatic latent image is formed.

The laser beam is concentrated to 600 DPI by the optical system. Consequently, in order to provide an image of high quality, it is necessary to reduce the toner particle size. In this example, the toner particle size of each color is 8 μm. In this case, the quality of black characters is most important for users. Therefore, black toner particles of small size (7 μm to 11 μm) are preferably used.

An example of the construction of the optical system of image exposure is shown as follows.

Polygonal mirror: 6 faces, rotational speed 23600 rpm An air bearing is employed.

Focal distance of the lens: f=140 mm

Dot clock: 20 MHz

Beam diameter: about 60×80 μm

[Development]

Figure 5:
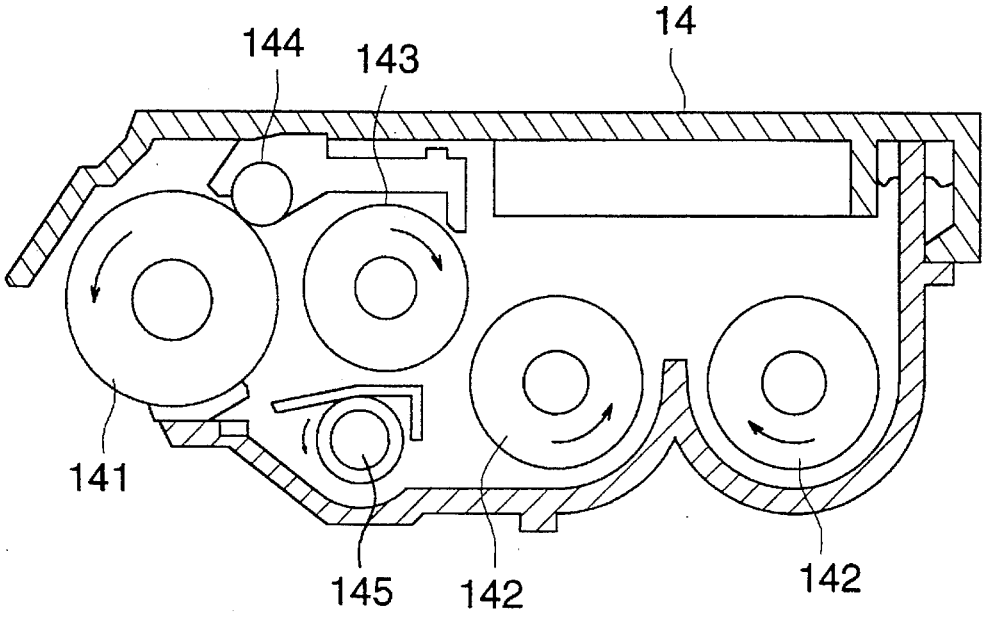
FIG. 5 is a schematic illustration showing the developing unit.

FIG. 5 shows the construction of the developing unit 14. Toner supplied from the toner box is dropped to a right end of the developing unit, and then toner and carrier are stirred and mixed by a pair of stirring screws 142 which are rotated in the opposite direction, so that a predetermined charging amount (Q/M) can be set.

Toner concentration is detected by the L-detection system or magnetic detection system. In accordance with the output frequency of detection, an amount of toner supply is controlled so that the toner concentration can be 5 to 7%.

The stirred two component developer is conveyed to the development sleeve 141 through the supply roller 143. Then he thickness of the developer layer is made to be thin by the layer thickness regulating member 144. After that, the developer layer is sent to the developing region of the photoreceptor drum 10. Then the reversal development of the electrostatic latent image is conducted under the following developing conditions.

Development gap: 0.5 mm

Amount of conveyed toner: 20 to 30 mg/cm$^2$

Development bias (AC): 2 KV, 8 KHz

Development bias (DC): –750 V

Rotational direction of developing sleeve: Normal direction with respect to photoreceptor drum Adjustment of image density: Rotational speed control of developing sleeve or control of developing bias (A reference board is formed on the photoreceptor by a laser beam. After development, the reflection density is measured and the image density is adjusted.)

Control of toner concentration: L detection system or magnetic detection system

Although not shown in the drawing, a toner bottle attached to the toner box may be used as a toner hopper. In this way, the toner supply apparatus can be made compact. When the toner bottle is made of opaque material, the residual amount of toner can be visually checked.

[Sheet Feeding]

Figure 6:
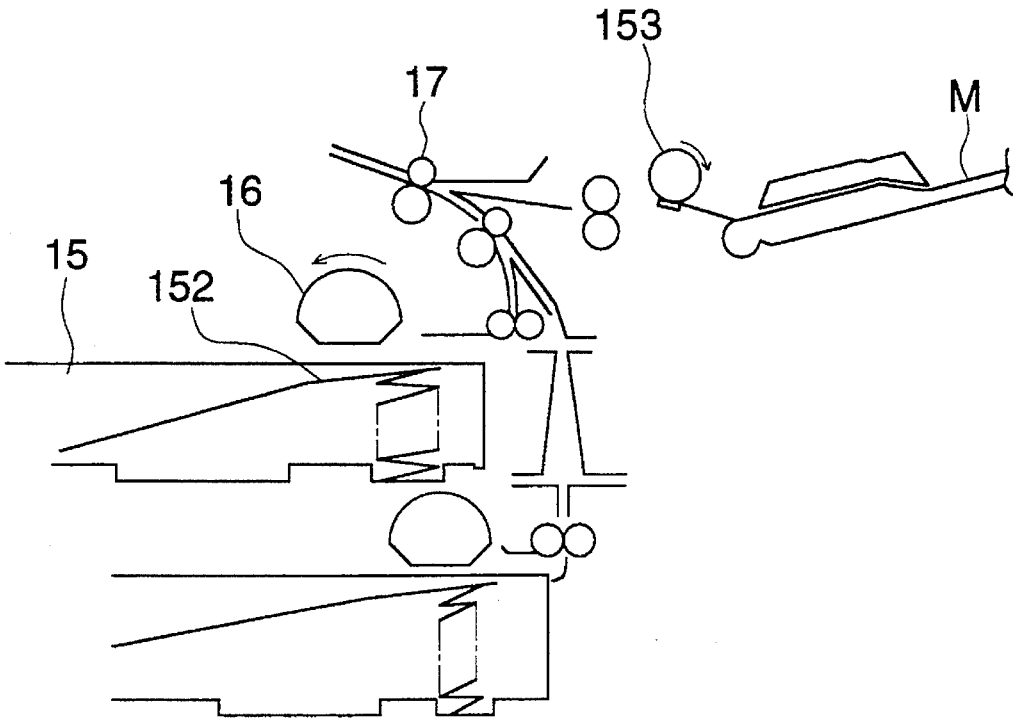
FIGS. 6(*a*) and 4(*b*) are schematic illustration showing the sheet feed section.
Figure 6:
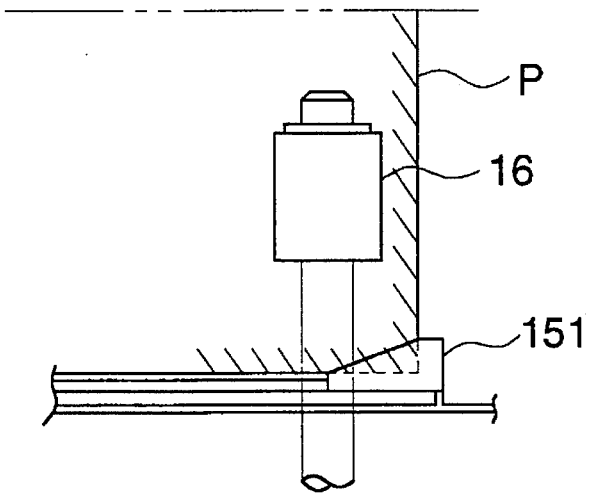
Figure 7:
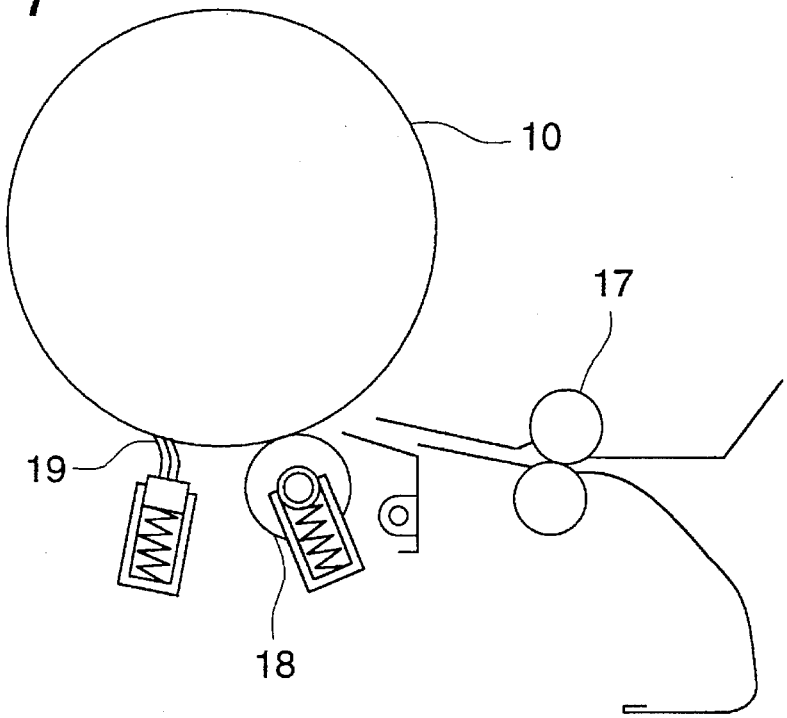
FIG. 7 is a schematic illustration showing the transfer section.

FIGS. 6(*a*) and 6(*b*) show sheet feeding sections for feeding sheets P. Recording sheets P are accommodated in the sheet feeding cassette 15, wherein one side of the recording sheets P is aligned along a reference surface. Consequently, a handling claw 151 is provided only on the reference surface side of the recording sheets P. A semicircular roller 16 is supported in the manner of a cantilever manner and disposed on the reference surface side of the recording sheets P.

The sheet feeding section is provided with an exclusive motor. The semicircular roller 16 is rotated in the arrowed direction, and only the uppermost recording sheet P on a pushup board 152 is conveyed by the action of the handling claw 151.

The recording sheet P conveyed out from the sheet cassette 15 is sent to the conveyance passage, and the conveying direction is changed. Immediately after the fore end of the recording sheet has passed through the sheet feeding roller 17, the motor is temporarily stopped by a signal sent from a sheet sensor not shown in the drawing. After the transfer timing has been adjusted, the motor is started again, so that the recording sheet P is fed to the transfer region while a predetermined angle is formed between the recording sheet P and the photoreceptor surface.

When the recording sheets P are fed by means of hand-feed, the hand-feed tray M is set at a position illustrated by a solid line in FIG. 1.

The recording sheet P is conveyed from the hand-feed tray M when the pickup roller 153 is rotated. In the same manner as the recording sheet fed from the sheet feeding cassette 15 described before, the recording sheet P fed from the hand-feed tray M is conveyed to the transfer region.

Types of sheets subjected to hand-feeding are usual recording sheets P of 16 lbs to 24 lbs. Further, thick sheets of 36 lbs and transparent sheets used for OHP are applied to hand-feeding. The hand-feed tray M may be removed, and an optional feeder may be attached to the apparatus so that envelopes can be fed.

[Transfer]

The position of the transfer roller 18 can be changed with respect to the circumferential surface of the photoreceptor drum 10. In the case where a monocolor image is formed, the transfer roller 18 comes into pressure contact with the circumferential surface of the photoreceptor drum 10 at all times. During the process of color image formation, the transfer roller 18 is withdrawn, and only when the transfer operation is conducted, the transfer roller 18 comes into pressure contact with the circumferential surface of the photoreceptor drum 10. On the other hand, the separation brush 19 is also contacted with and withdrawn from the circumferential surface of the photoreceptor drum 10 synchronously with the transfer roller 18.

In this example, a voltage of ∓KVDC to +4 KVDC is impressed upon the transfer roller 18, the surface of which is cleaned by a cleaning blade, and a bias voltage in which DC and AC voltage are superimposed is impressed upon the separation brush 19.

[Fixing]

Figure 8:
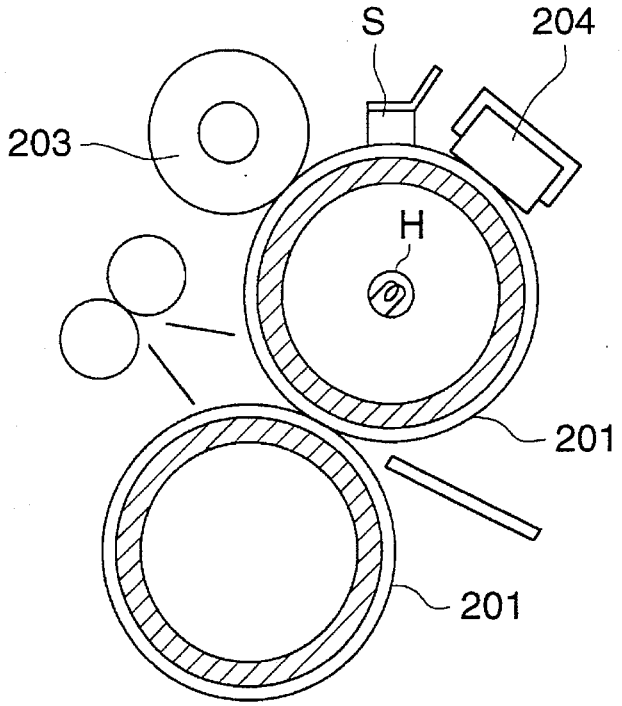
FIG. 8 is a schematic illustration showing the fixing unit.

As illustrated in FIG. 8, the fixing unit 20 of this example is a heat-roller type fixing unit composed of a pair of rollers. In the upper roller 201, the heater H is assembled, and the upper roller 201 is rotated clockwise. The lower roller 202 is idly rotated coming into pressure contact with the upper roller 201. The recording sheet P is held by the nip portion formed by the upper and lower rollers. In this way, the recording sheet P is heated so that the toner image can be fused.

Both upper and lower rollers are covered with a heat resistant tube. By the upper and lower rollers, a linear nip portion is formed, so that the occurrence of wrinkles can be prevented in the case where envelopes are conveyed.

The temperature on the circumferential surface of the upper roller 201 is controlled when it is detected by the temperature sensor S, so that the temperature can be maintained in a predetermined temperature range. When a cleaning roller 203 comes into pressure contact with the upper roller 201, stains of toner can be removed. When 40000 sheets are printed, the cleaning roller is replaced with a new one. When the fixing heater is not used exceeding a predetermined period of time, the fixing heater is set in the SLEEP MODE, so that electric power can be saved.

In the case where transparent sheets used for OHP are applied, in order to enhance the transmission factor, it is necessary to make the toner image surface smooth so as to prevent irregular reflection. For this reason, the surface of the upper roller 201 is coated with silicon oil by an oil pad 204 provided on the circumferential surface.

In the apparatus of this example, the conveyance speed of transfer sheets can be switched to 3 steps of 100, 50, 12.5 m/sec, so that 3 types of transfer sheets, which are regular sheets, envelopes and transparent sheets, can be applied to the apparatus.

In this connection, when a toner, the fusing temperature of which is low, is used, the setting temperature of the upper roller 201 can be lowered to about 180° C. When sponge material (coated with porous PTFE) is used for the oil pad 204, the upper roller 201 is uniformly pressed by the oil pad 204, so that oil can be uniformly coated.

With reference to FIGS. 9 to 12(*b*), the first disconnecting construction will be explained as follows, wherein each unit is connected to and disconnected from the apparatus by the first disconnecting construction.

The photoreceptor drum 10, PCL11, charger 12, each developing unit 14 and cleaning unit 22 are mounted on the drum frame 30.

Figure 9:
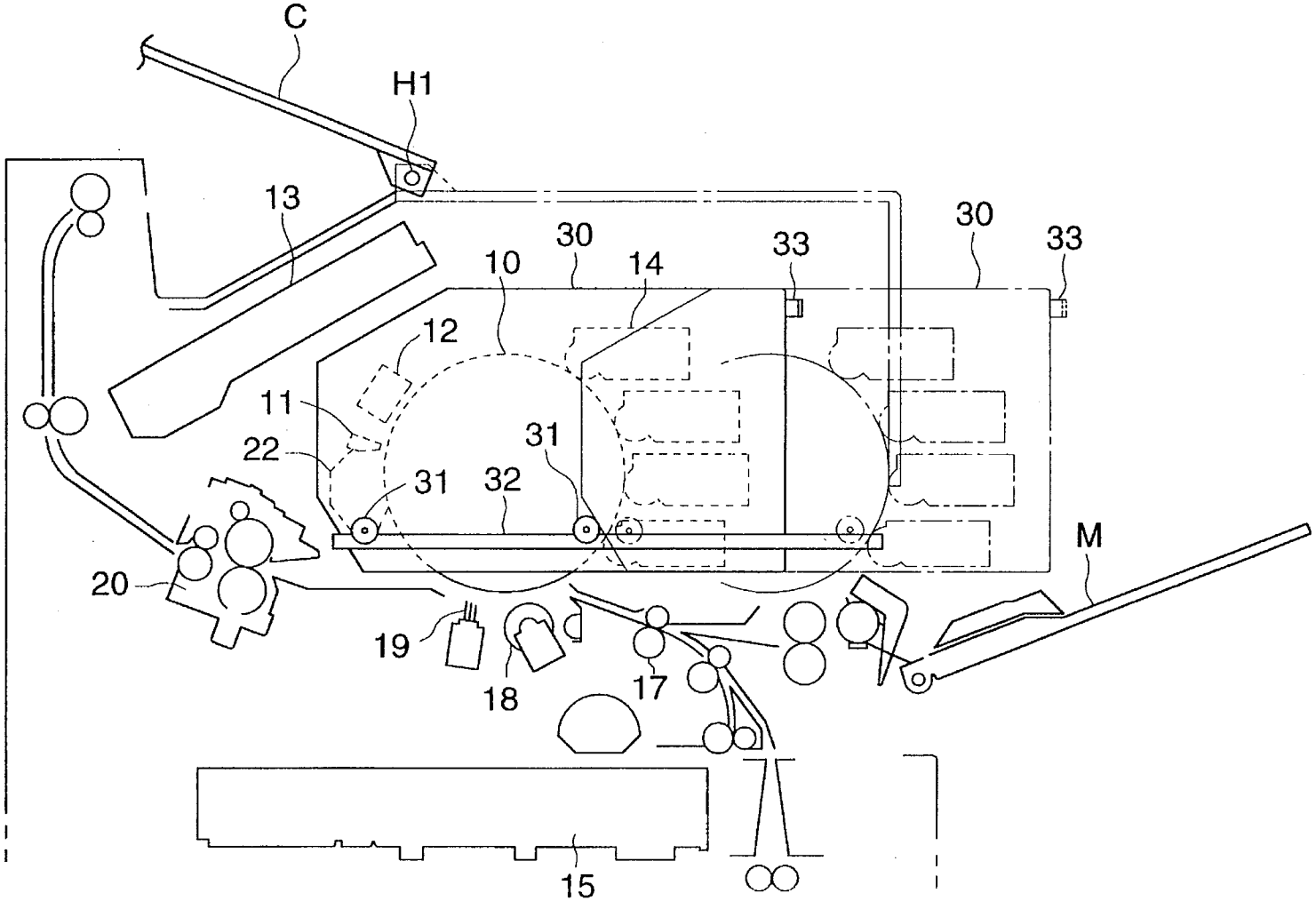
FIG. 9 is a schematic illustration showing the first detaching construction.

As illustrated in FIG. 9, a pair of rollers 31 are attached to the drum frame 30. The pair of roller 31 are engaged with rail members 32 provided in the apparatus, so that the drum frame 30 is supported on the rail members 32. The drum frame 30 is fixed at a predetermined position by an engaging unit not shown in the drawing, wherein the engaging unit can be released when necessary.

The drum frame 30 can be pulled out to a position illustrated by a one-dotted chain line in the following manner. The hand-feed tray M is opened and set at the sheet feeding position. The cover C to cover an upper portion of the apparatus is rotated around the support shaft H1 so that the cover C is opened. Then the handle is pulled by an operator so as to move the drum frame 30 to the right on the rail members 32.

As a result of the foregoing, the transfer region and the sheet conveyance passage connected to the transfer region are widely opened. Therefore, the operator can put his hands into the apparatus from the upper portion. Accordingly, it is possible for the operator to carry out jam clearance without touching each unit in the drum frame 30. In the case of jam clearance in the sheet feeding section, the sheet feed cassette 15 is pulled out to the right in the drawing, that is, the sheet feed cassette 15 is pulled out onto the front side of the apparatus.

Due to the foregoing construction, even when the drum frame 30 is moved to the right for jam clearance, the sheet feeding section or the multi-feeder tray exists immediately below, so that the photoreceptor receptor surface is not substantially exposed and stained.

In FIG. 9, the drum frame 30 is drawn out to a position shown by the one-dotted chain line. In FIG. 9, the drum frame 30 may be drawn out to the right so that the photoreceptor surface corresponding to the transfer section can be protected by the multi-feed tray. Due to the foregoing, the transfer region is more widely opened and jam clearance can be easily carried out.

In this example, the exposed portion of the photoreceptor is protected by the sheet feeding section or the multi-feed tray. However, it is possible to protect the exposed portion of the photoreceptor by the apparatus main body including the sheet feeding tray, sorter and finisher.

Next, the drum frame 30 is explained with reference to FIG. 10.

Figure 10:
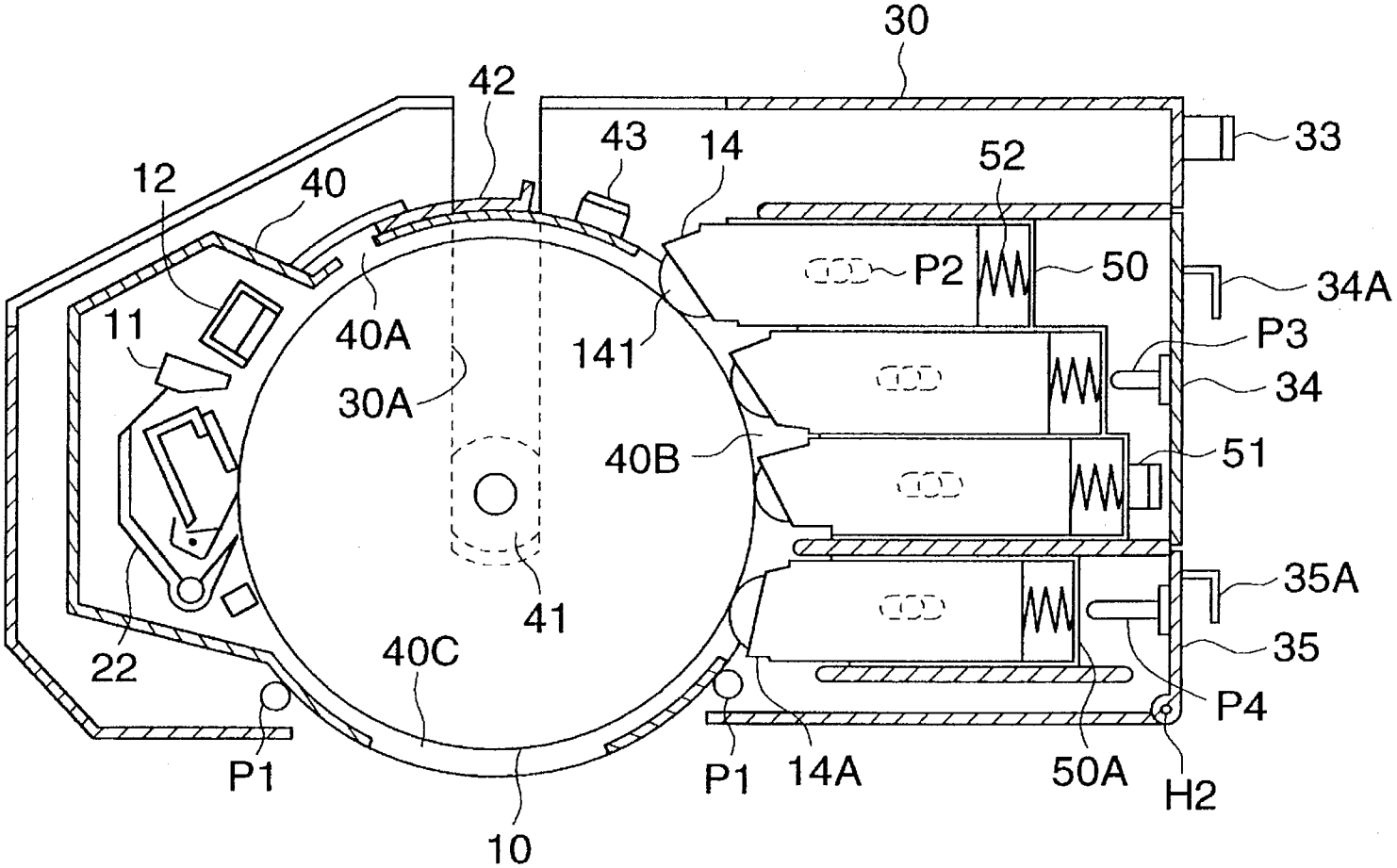
FIG. 10 is a sectional arrangement view showing the drum frame used for the first detaching construction.

As illustrated in FIG. 10, the aforementioned units accommodated in the drum frame 30 are respectively provided in the drum cartridge 40, developing cartridge 50 and developing cartridge 50A. In this case, the photoreceptor drum 10 is assembled to the drum cartridge 40. The developing units 14 including developers of Y, M and C are assembled to the developing cartridge 50. Only the developing unit 14A including developer of K is assembled to the cartridge 50A.

Not only the photoreceptor drum 10 but also the PCL11, charger 12 and cleaning unit 22 are assembled to the drum cartridge 40. All the photoreceptor surface except for the portions corresponding to the openings 40A, 40B and 40C is covered, wherein the openings 40A, 40B and 40C respectively correspond to the exposure, development and transfer regions.

The setting position of the drum cartridge 40 is determined in the following manner. The bearing portion 41 of the photoreceptor drum 10 is engaged with a longitudinal groove 30A of the drum frame 30. The bottom portion of the drum cartridge 40 comes into contact with a pair of position regulating pins P1 disposed on both inner side surfaces of the drum frame 30. In this way, the horizontal and vertical positions of the drum cartridge 40 are regulated, and each unit accommodated in the drum cartridge 40 can be positioned at a predetermined image forming position.

In this connection, concerning the exposure region 40A, a sliding type shielding plate 42 is provided to a long slender slit hole through which a beam of light for writing can pass. In this way, the photoreceptor surface is not touched by the operator's hand.

Figure 11:
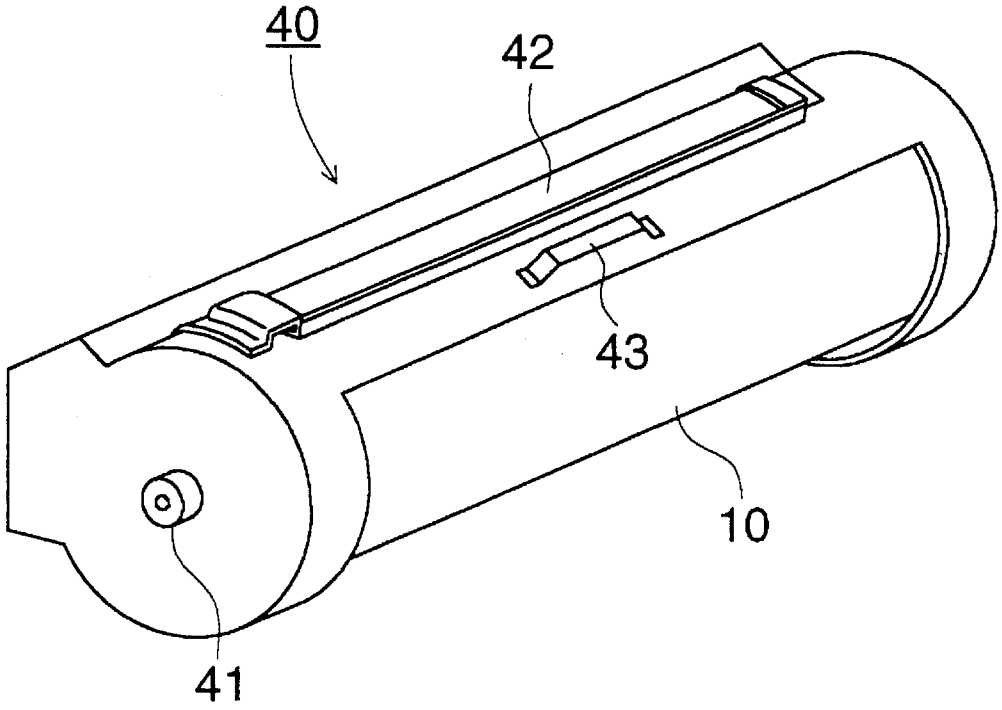
FIG. 11 is a perspective view showing the appearance of the drum cartridge.

FIG. 11 is a perspective view showing the appearance of the drum cartridge 40. The drum cartridge 40 can be easily disconnected from the drum frame 30 when the handle 43 is lifted upward after the developing cartridge 50 has been taken out.

Long holes are formed on both sides of each of the developing cartridges 50 and 50A. Under the condition that the long holes are engaged with the position regulating pins P2 protruding from each developing unit, the developing cartridges 50 and 50A are pushed by the compression spring 52.

The developing cartridges 50 and 50A are pushed to the left by the pushing pins P3 and P4 attached to the side doors 34 and 35 which form a right side of the drum frame 30. When a spacing roller (not shown) mounted on the same shaft as that of each developing sleeve 141 is contacted with the circumferential peripheral surface of the photoreceptor drum 10, a gap between the circumferential surface of each developing sleeve 141 and the photoreceptor surface can be determined, that is, a developing gap can be determined.

In this connection, the side doors 34 and 35 are fixed by an engaging device, which can be released, at a closed position, resisting a reaction force of the compression spring 52.

Figure 12:
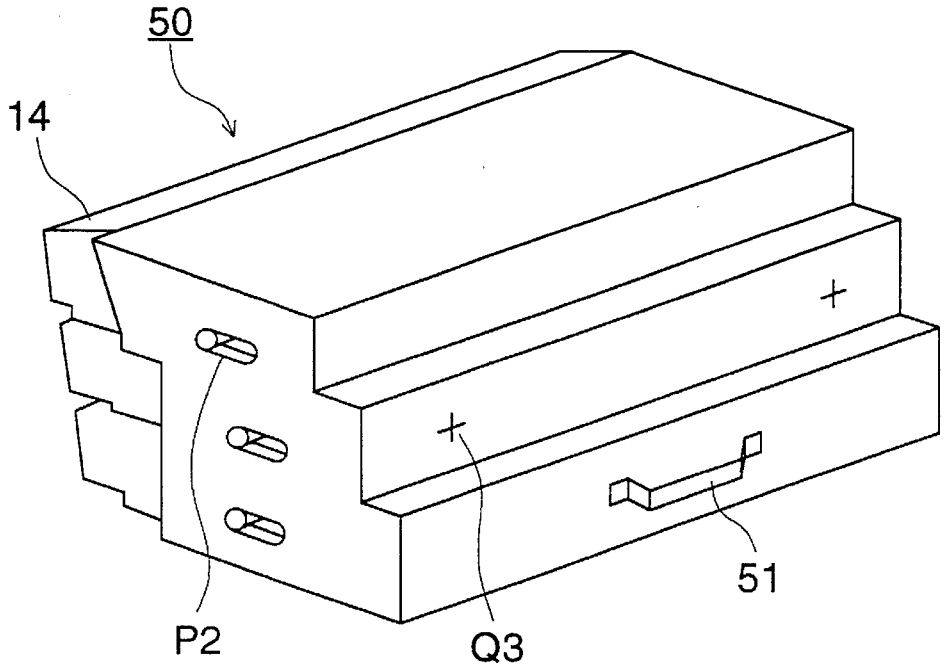
FIGS. 12(*a*)and 12(*b*) are perspective view showing the appearance of the developing cartridge.
Figure 12:
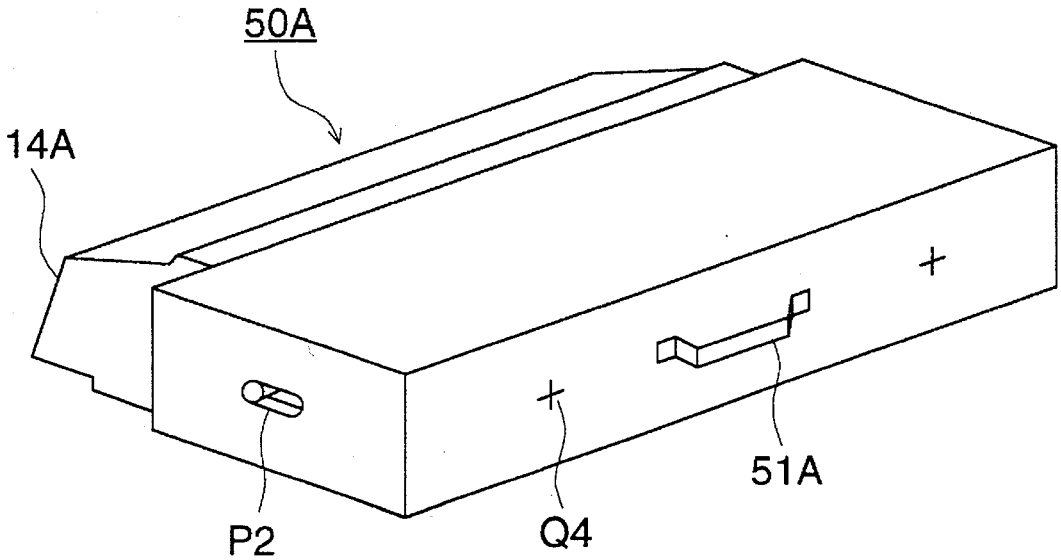

FIGS. 12(*a*) and 12(*b*) respectively show the appearance of the developing cartridges 50 and 50A. When the side door 34 or 35 mounted on the common support shaft H2 is opened by the handle 34A or 35A, each developing cartridge can be individually pulled out from the drum frame 30.

Due to the foregoing construction, only the developing unit 14A having developer K used very frequently can be individually inspected and replaced.

In order to push the developing unit accommodated in each cartridge against the photoreceptor surface in a well-balanced condition, the pushing pins P3 and P4 are horizontally provided at positions corresponding to the points Q3 and Q4 shown in FIGS. 12(*a*) and 12(*b*).

Figure 13:
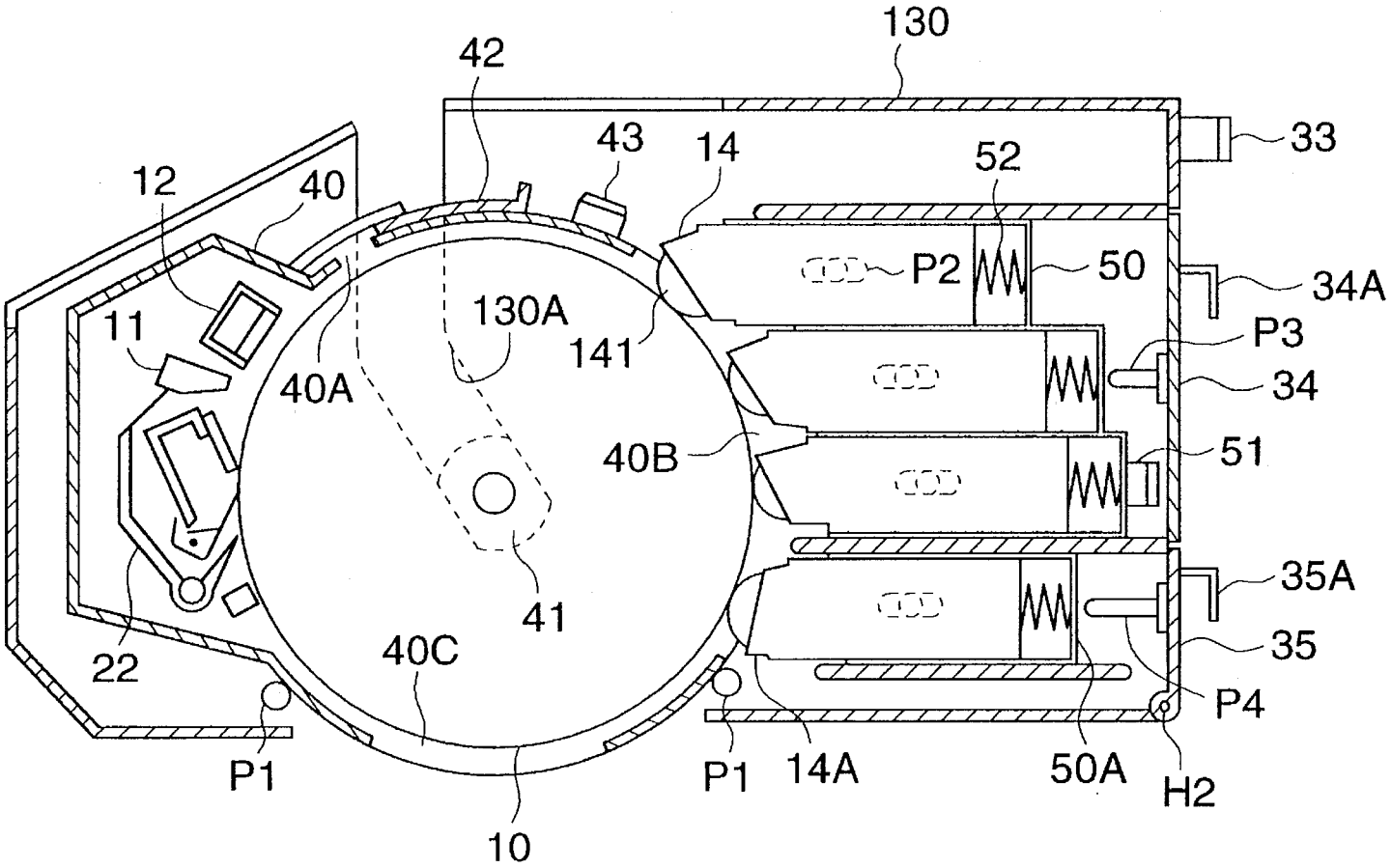
FIG. 13 is a sectional view showing an arrangement of the drum frame used for the second detaching construction.
Figure 14:
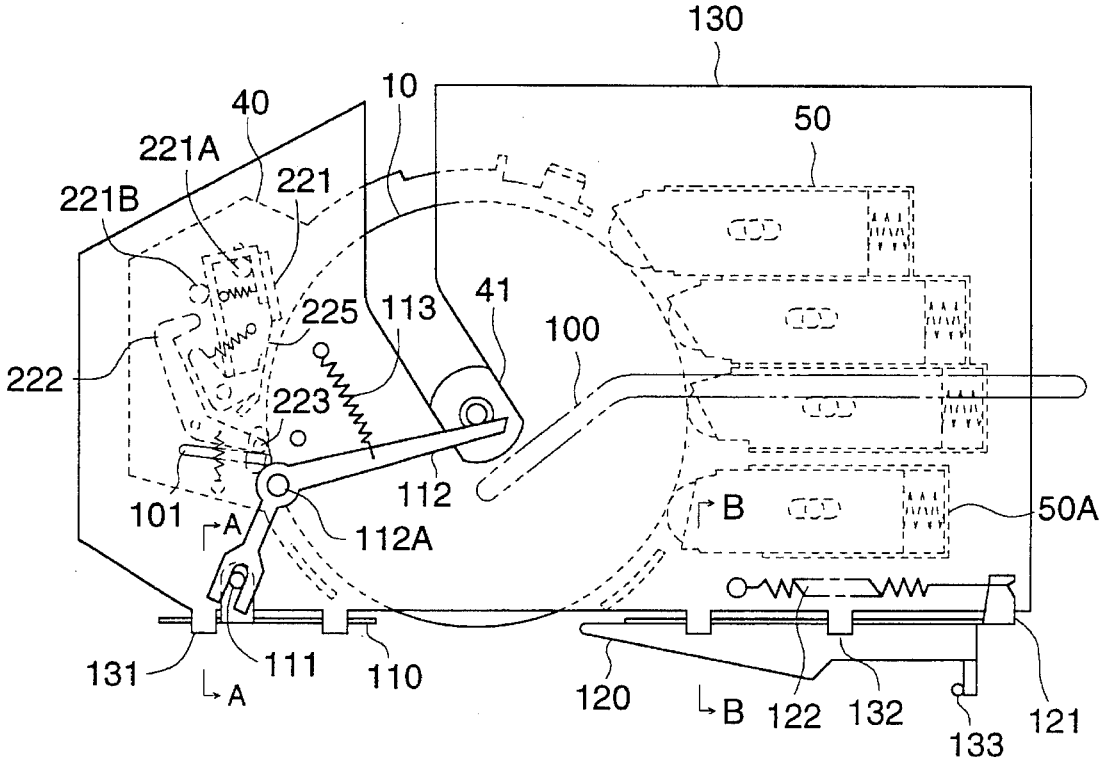
FIGS. 14(*a*) and 14(*b*) are schematic illustrations (I) showing the second detaching construction.
Figure 14:
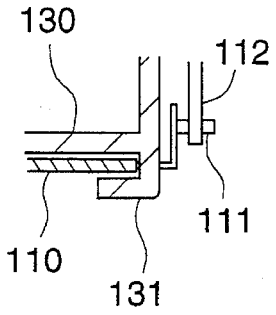
Figure 14:
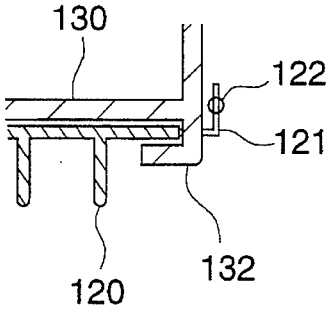
Figure 15:
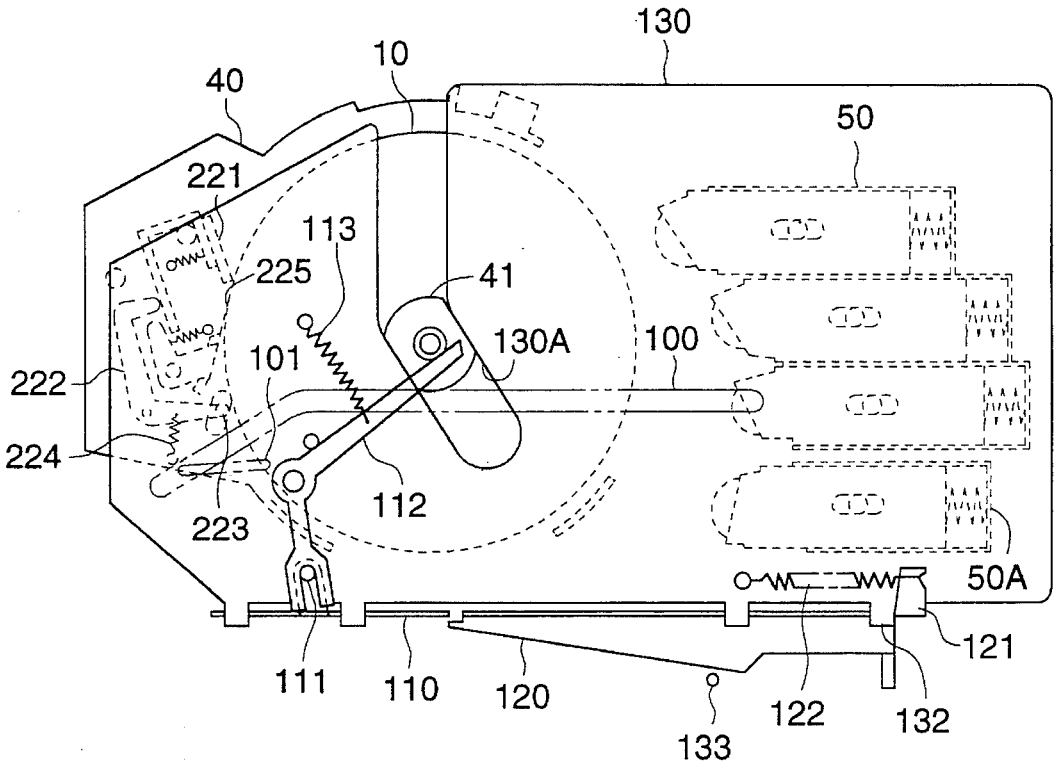
FIG. 15 is a schematic illustration (II) showing the second detaching construction.

With reference to FIGS. 13 to 15, the second detaching construction of each unit with respect to the apparatus main body and its procedure will be described as follows.

A drum frame 130 used for the construction is shown in FIG. 13. Like reference characters are used to indicate like parts in the views.

In the case of the drum frame 30 shown in FIG. 10, the configuration of the longitudinal groove 130A by which the drum cartridge 40 is regulated, is different, and other points are the same.

The color image forming apparatus of this construction is the same as that shown in FIG. 9. In addition to that, the color image forming apparatus of this construction is composed in the following manner. In FIG. 14(*a*), a cam member 100 shown by a two-dotted chain line is provided. In the case where the drum frame 130 is pulled out, the bearing portion 41 of the photoreceptor drum 10 comes into contact with the cam member 100, and rises upward along the vertical groove 130A of the drum frame 30 as shown in FIG. 15.

As a result, the photoreceptor drum 10 is withdrawn upward, so that the drum frame 130 can be pulled out without causing any problems. At the same time, the photoreceptor drum 10 is moved to the opposite side of the developing cartridges 50, 50A together with the drum cartridge 40. Therefore, the pressure contact of each developing unit with respect to the photoreceptor surface can be automatically released.

As shown by a one-dotted chain line in FIG. 14(*c*), a protruding portion 101 is provided on the inside surface of the drum frame 130. In the case where the drum cartridge 40 is accommodated at a predetermined position in the drum frame 130, that is, in the case where the drum frame 130 is set at an image forming position, the protruding pin 223 of the pressure contact lever 222 provided in the cleaning unit 22 is engaged, so that the pressure contact lever 222 is located at a position where it is rotated counterclockwise, resisting the tension spring 224. Accordingly, the blade 221 of the cleaning unit 22 is rotated clockwise around the support shaft 221A by the action of the tension spring, and the blade 221 comes into contact with the stop pin 221B. As a result, the blade 221 is separated from the circumferential surface of the photoreceptor drum 10, and put in a condition in which the blade 221 can be contacted or released by the action of a solenoid not shown in the drawing.

Linked with the motion of the blade 221, the resilient toner collecting plate 224 is also separated from the circumferential surface of the photoreceptor drum 10.

In the case where the drum frame 130 is pulled out and the drum cartridge 40 is raised, the pin 223 is withdrawn from the protruding portion 101 as shown in FIG. 15. Accordingly, by the force of the tension spring 224, the pressure contact lever 222 is rotated clockwise, so that the blade 221 is maintained in a condition in which the blade 221 comes into pressure contact with the circumferential surface of the photoreceptor drum 10. At the same time, linked with the blade 221, the toner collecting plate 224 also comes into pressure contact with the circumferential surface of the photoreceptor drum 10. As a result, even when the posture of the drum cartridge 40 is changed in the case where it is removed from the drum frame 30, scatter of used toner from the cleaning unit 22 can be prevented.

Conveyance guide members 110 and 120 for guiding the recording sheet P in the conveyance direction are provided on the lower surface of the drum frame 130.

As illustrated in FIGS. 14(*a*) and 14(*b*), the conveyance guide member 110 is slidably supported by a bent portion 131 of the drum frame 130. An engaging pin 111 is protruded from the rising portion of he conveyance guide member 110.

The drum frame 130 is provided with a drive lever 112 on its side, wherein the drive lever 112 is pushed counterclockwise around the shaft 112A by the tension spring 113. One end of the drive lever 112 is contacted with the bearing portion 41 of the photoreceptor drum 10, and the other end is engaged with an engaging pin 111 of the conveyance guide member 110. In this way, the conveyance guide member 110 is set at a predetermined position.

As illustrated in FIGS. 14(*a*) and 14(*c*), the conveyance guide member 120 is slidably supported by the bent portion 132 of the drum frame 130. The conveyance guide member 120 is pushed to the left by the action of the tension spring 122 provided between the rising portion 121 and the drum frame 130. In this case, the conveyance guide member 120 comes into contact with a stop pin 133 fixed to the apparatus main body, so that it is located at a predetermined position.

When the drum frame 130 is pulled out to the right as described above, the photoreceptor drum 10 is raised upward. Then, as illustrated in FIG. 15, the drive lever 112 is rotated counterclockwise by the force of the spring 113, and the conveyance guide member 110 is slid to the right through the engaging pin 111. On the other hand, the conveyance guide member 120 is moved to the left with respect to the drum frame 130 by the force of the tension spring 122. Therefore, the rising portion 121 is contacted with the bent portion 132 of the drum frame 130. As a result of the foregoing, an opening on the lower side of the drum frame 130 is closed by each conveyance guide member, so that the transfer region of the photoreceptor drum 10 is shielded. In this way, the transfer region can be protected from operator's hands in the process of jam clearance.

When the drum frame 130 is moved to the left so that it can be returned to a predetermined position, the conveyance guide member 120 is contacted with the stop pin 133 again. Therefore, the conveyance guide member 120 is moved to the right with respect to the drum frame 130. On the other hand, when the photoreceptor drum 10 is lowered, the drive lever 112 is forcibly rotated clockwise, so that the conveyance guide member 110 is moved to the left.

Consequently, the conveyance guide members 110 and 120 are returned to the positions shown in FIG. 14(*a*), and the transfer region of the photoreceptor drum 10 is opened.

In this example, each conveyance guide member is provided separately from the drum frame 130. However, it is possible to form the conveyance guide member integrally with the drum frame 130 in such a manner that the lower side of the drum frame 130 is deformed so as to be formed into a conveyance guide member, and it is moved in accordance with the drawing motion of the drum frame 130.

Figure 16:
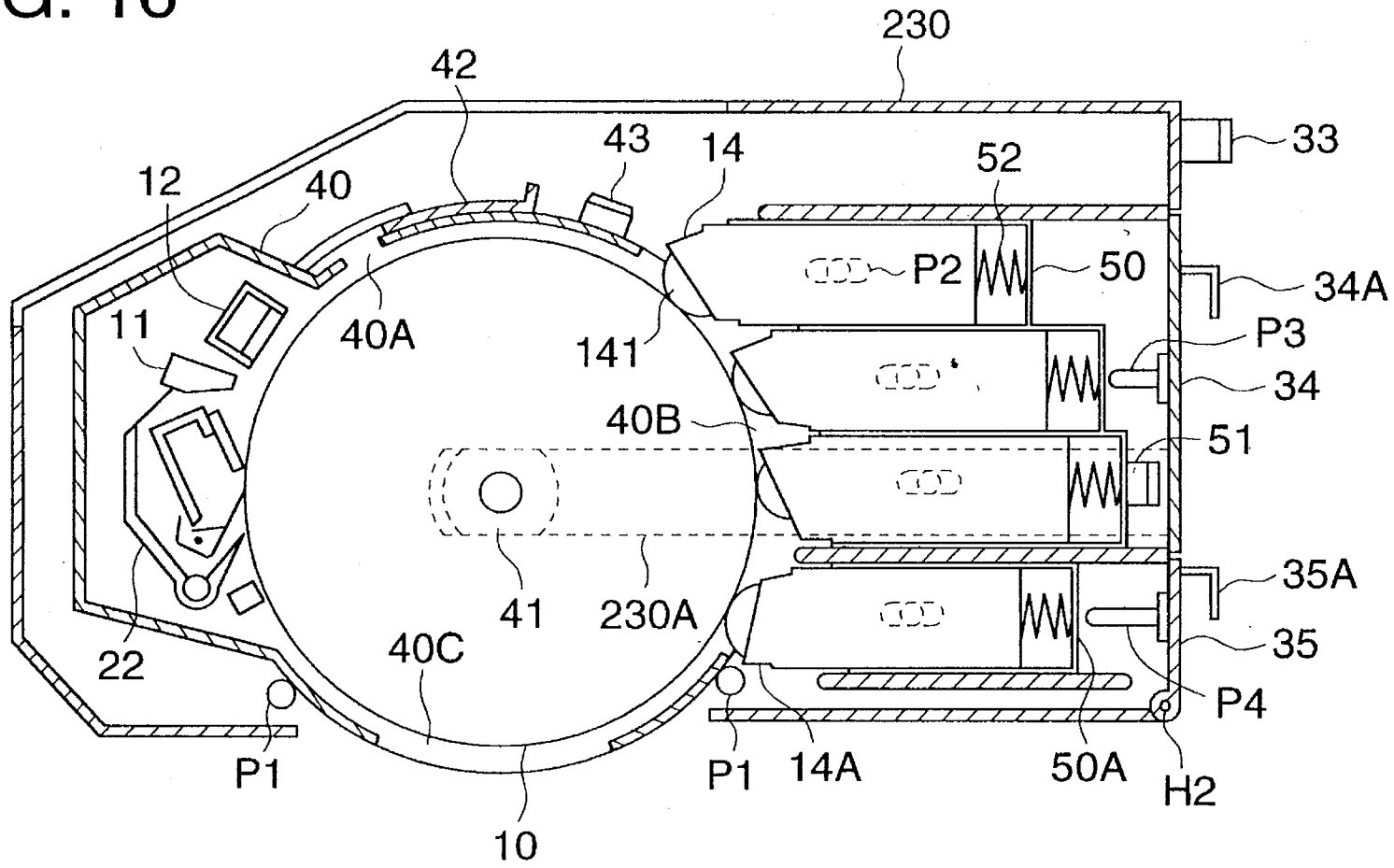
FIG. 16 is a sectional arrangement view of the drum frame used for the third detaching construction.
Figure 17:
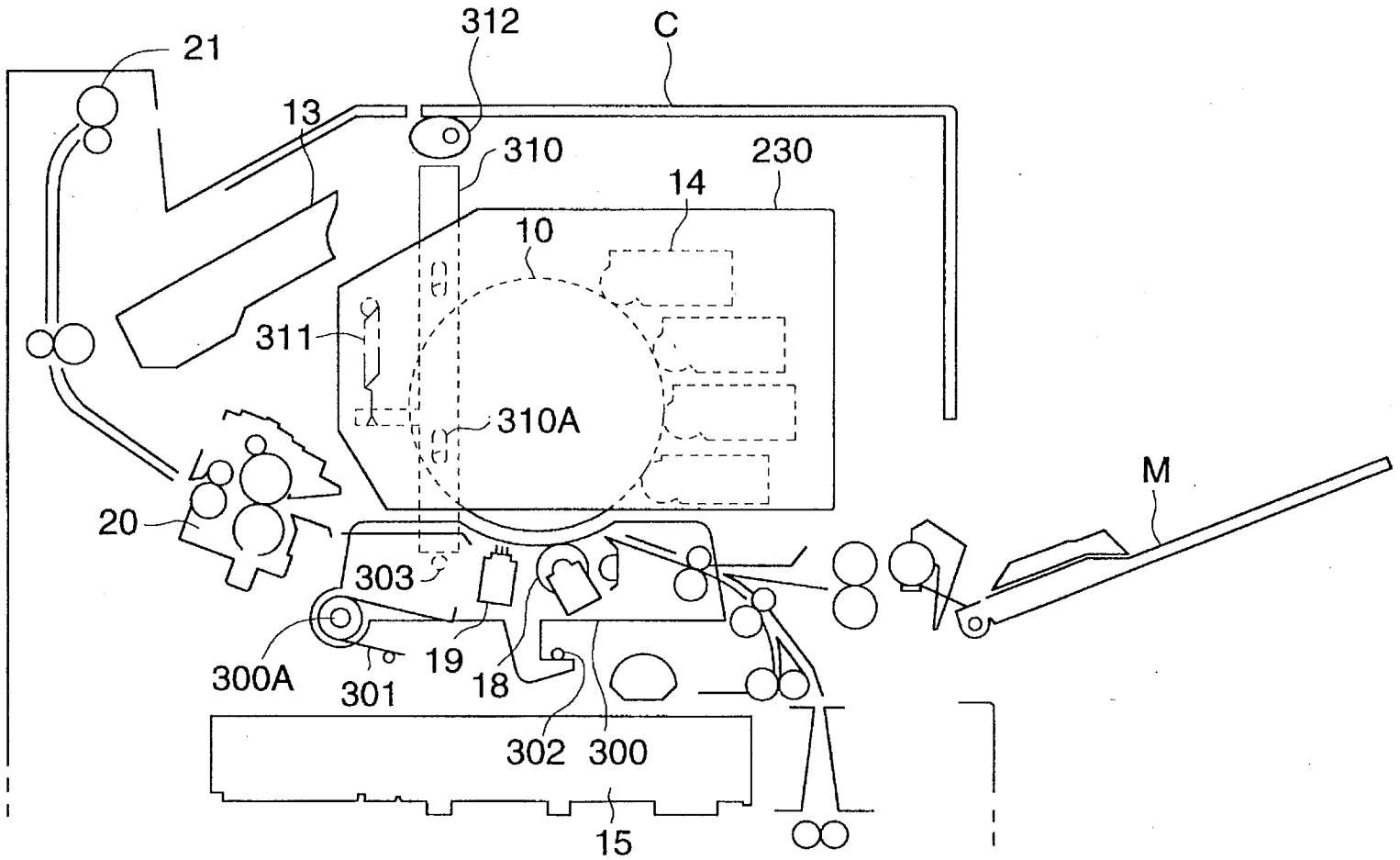
FIG. 17 is a schematic illustration (I) showing the third detaching construction.
Figure 18:
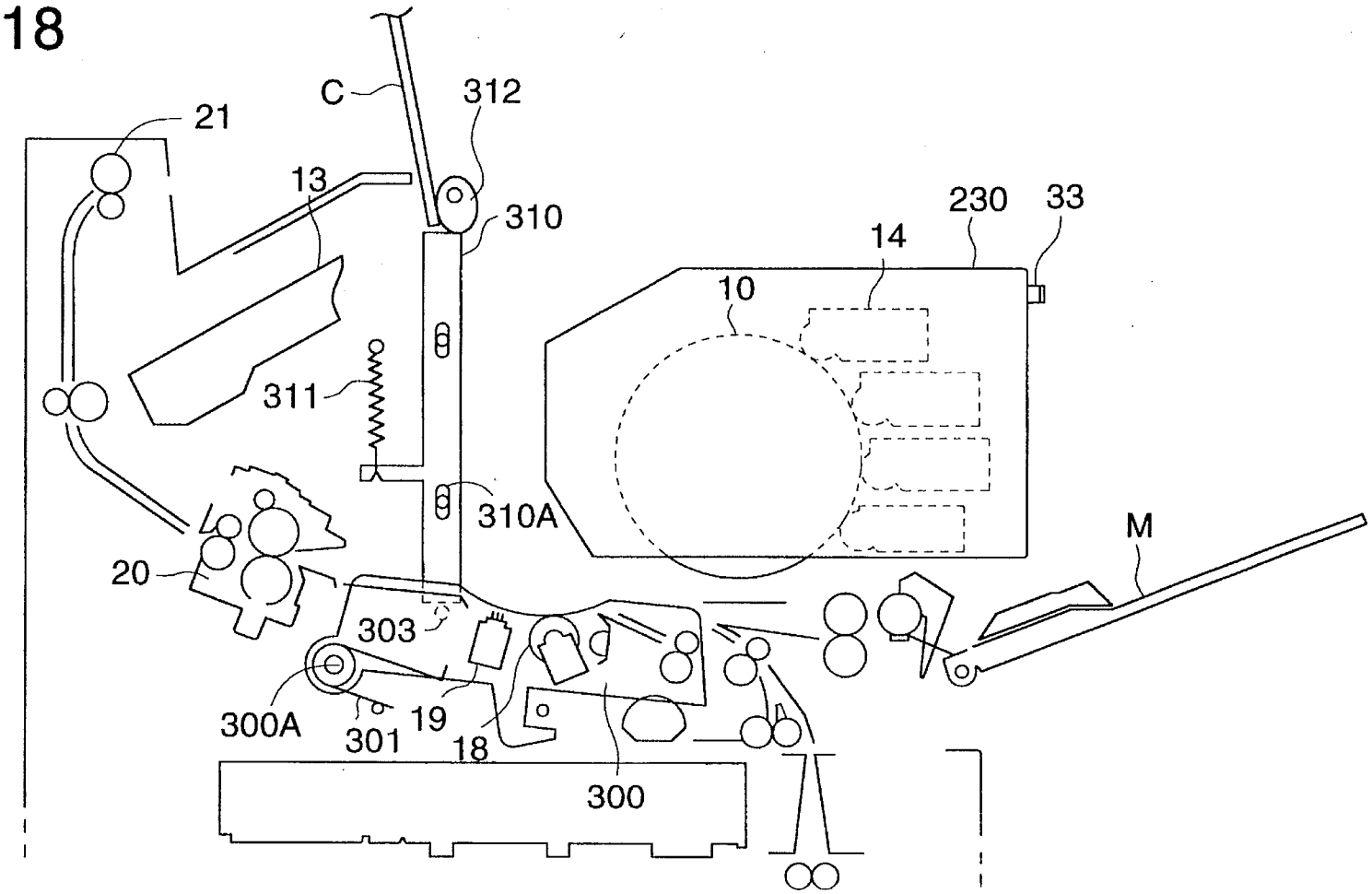
FIG. 18 is a schematic illustration (II) showing the third detaching construction.

With reference to FIGS. 16 to 18, the third detaching construction of each unit with respect to the apparatus main body and its procedure will be described as follows.

A drum frame 230 used for the construction is shown in FIG. 16. Like reference characters are used to indicate like pares in the views.

In the case of the drum frame 30 shown in FIG. 10, the direction of the longitudinal groove 230A for regulating the drum cartridge 40, is different, and other points are the same.

The image forming apparatus of the present invention is shown in FIG. 17. As illustrated in FIG. 17, the transfer roller 18, separation brush 19 and conveyance guide member for conveying recording sheets P are provided and held in an integrated frame-shaped support member 100.

The support member 300 is capable of being rotated with a fulcrum of the support shaft 300A. The support member 300 is pushed counterclockwise by the action of a torsion spring 101 attached to the support shaft 300A. Therefore, the support member 300 comes into contact with a stop pin 302. In this way, the transfer roller 18, separation brush 19 and each conveyance guide member can be set at a predetermined position on the circumferential surface of the photoreceptor drum 10.

On the other hand, the apparatus main body is provided with a pushing member 310 capable of being slid vertically through a pair of long holes 310A. This pushing member 310 is pushed upward at all times by a tension spring 311 provided between the apparatus main body and the pushing member 310.

The upper end of the pushing member 310 is opposed to an eccentric cam 312 fixed at the rotational center of the cover member C which is an external member of the apparatus main body. On the other hand, the lower end of the pushing member 310 is opposed to a pushing pin 303 fixed at the support member 300.

As illustrated in FIG. 17, when the cover member C is closed with respect to the apparatus main body, the upper end of the pushing member 310 is a little separated from the eccentric cam 312, and the lower end is a little separated from the pushing pin 303. Therefore, the support member 300 is maintained in a free condition and contacted with the stop pin 302.

When the cover member C is opened as illustrated in FIG. 18, the eccentric cam 312 comes into contact with the upper portion of the pushing member 310, and further the eccentric cam 312 pushes down the pushing member 310, resisting the force of the tension spring 311. Accordingly, the lower end of the pushing member 310 comes into contact with the pushing pin 303 of the support member 300, and further rotates the support member 300 clockwise, resisting the force of the torsion spring 101.

As a result of the foregoing, the transfer roller 18, separation brush 19 and each conveyance guide are moved downward as illustrated in FIG. 18, so that they are withdrawn from the circumferential surface of the photoreceptor drum 10. Due to the foregoing, the drum frame 230 can be drawn out without causing any problems.

In this example, when the cover member C is opened, the transfer section is withdrawn. It is possible to withdraw the image forming section, that is, it is possible to withdraw the drum frame 230 by the same means.

When the side doors 34 and 35 are opened, from the drum frame 30 pulled out to the predetermined position, first, the developing cartridges 50 and 50A are taken out from the front of the apparatus main body, and then the drum cartridge 40 is taken out in the same direction. In the case of assembly, a reverse procedure may be adopted.

As described above in detail, according to the present invention, jam clearance of transfer sheets can be made when an operator conducts a simple operation by which the units are integrally moved in the apparatus under the condition that the operator does not touch the image forming units such as a photoreceptor and developing units. Further, the image forming units can be attached to and detached from the apparatus main body under the condition that they are respectively accommodated in the cartridge so that the image forming units are not subjected to stain and damage. Accordingly, the color image forming apparatus of the present invention is very advantageous in maintenance.

What is claimed is:

1. A color image forming apparatus, comprising:

an image retainer having an image retaining surface on which a color toner image is retained;

a charger for charging the image retaining surface;

an exposure device for forming a latent image on the charged image retaining surface;

a plurality of developing devices for developing the latent image on the image retaining surface so as to form a toner image;

a transferring device for transferring the toner image from the image retaining surface at a transfer section to a recording sheet;

a conveyor for conveying the recording sheet to the transfer section on the transferring device;

a cleaner for cleaning residual toner on the image retaining surface;

a holder for holding the image retainer, the charger, the plurality of developing devices and the cleaner in one body;

a housing;

a support for supporting the holder dismountably in the housing so that the holder is drawable out from a first position at which the holder is set in the housing to a second position at which jam disposition is conducted, wherein the holder is drawable out of the housing in a direction parallel to a recording sheet-conveying direction of the conveyor; and a member comprising a manual feed tray forming a portion of the apparatus, the member covering the image retaining surface at the transfer section when the holder is at the second position.

2. The apparatus of claim 1, wherein the cleaner includes a cleaning blade arranged to come in contact with the image retaining surface, and wherein the cleaning blade is spaced away from the image retaining surface when the holder is at the second position.

3. The apparatus of claim 1, wherein the plurality of developing devices are placed at a first position that is in close proximity to the image retainer when the holder is at the first position, and the plurality of developing devices are moved in a direction away from the image retainer to a second position when the holder is at the second position.

4. The apparatus of claim 1, wherein the plurality of developing devices are mountable on and dismountable from the holder when the holder is at the second position.

5. The apparatus of claim 1, wherein the image retainer is moved in a direction away from the transfer section on the holder as the holder moves from the first position to the second position.

6. The apparatus of claim 1, wherein the housing includes an opening and a cover member to at least one of open and close the opening, and the transferring device is associated with a mechanism that is movable interlockingly with the cover member so that the transferring device is moved in a direction away from the transfer section on the holder when the cover member opens the opening.

7. The apparatus of claim 1, wherein the housing includes an opening and a cover member to at least one of open and close the opening, and the image retainer is associated with a mechanism that is movable interlockingly with the cover member so that the image retainer is moved in a direction away from the transfer section on the holder when the cover member opens the opening.

8. The apparatus according to claim 1, wherein the housing has an opening through which the holder is further drawable out from the second position to an outside of the housing.

9. A color image forming apparatus, comprising:

an image retainer having an image retaining surface on which a color toner image is retained;

a charger for charging the image retaining surface;

an exposure device for forming a latent image on the charged image retaining surface;

a plurality of developing devices for developing the latent image on the image retaining surface so as to form a toner image;

a transferring device for transferring the toner image from the image retaining surface at a transfer section to a recording sheet;

a conveyor for conveying the recording sheet to the transfer section on the transferring device;

a cleaner for cleaning residual toner on the image retaining surface;

a holder for holding the image retainer, the charger, the plurality of developing devices and the cleaner in one body;

a housing;

a support for supporting the holder dismountably in the housing so that the holder is drawable out from a first position at which the holder is set in the housing to a second position at which jam disposition is conducted, wherein the holder is drawable out of the housing in a direction parallel to a recording sheet-conveying direction of the conveyor;

a member forming at least a portion of the conveyor, the member covering the image retaining surface at the transfer section when the holder is at the second position.

10. The apparatus of claim 9, wherein the member forming at least a portion of the conveyor is held by the holder.

11. The apparatus of claim 9, wherein the member forming at least a portion of the conveyor is held by the holder such that said portion of the conveyor covers the image retaining surface at the transfer section as the holder is drawn out from the first position to the second position.

12. The apparatus of claim 9, wherein the cleaner includes a cleaning blade arranged to come in contact with the image retaining surface, and wherein the cleaning blade is spaced away from the image retaining surface when the holder is at the second position.

13. The apparatus of claim 9, wherein the plurality of developing devices are placed at a first position that is in close proximity to the image retainer when the holder is at the first position, and the plurality of developing devices are moved in a direction away from the image retainer to a second position when the holder is at the second position.

14. The apparatus of claim 9, wherein the plurality of developing devices are mountable on and dismountable from the holder when the holder is at the second position.

15. The apparatus of claim 9, wherein the image retainer is moved in a direction away from the transfer section on the holder as the holder moves from the first position to the second position.

16. The apparatus of claim 9, wherein the housing includes an opening and a cover member to at least one of open and close the opening, and the transferring device is associated with a mechanism that is movable interlockingly with the cover member so that the transferring device is moved in a direction away from the transfer section on the holder when the cover member opens the opening.

17. The apparatus of claim 9, wherein the housing includes an opening and a cover member to at least one of open and close the opening, and the image retainer is associated with a mechanism that is movable interlockingly with the cover member so that the image retainer is moved in a direction away from the transfer section on the holder when the cover member opens the opening.

18. The apparatus according to claim 9, wherein the housing has an opening through which the holder is further drawable out from the second position to an outside of the housing.

19. A color image forming apparatus, comprising:

an image retainer having an image retaining surface on which a color toner image is retained;

a charger for charging the image retaining surface;

an exposure device for forming a latent image on the charged image retaining surface;

a plurality of developing devices for developing the latent image on the image retaining surface so as to form a toner image;

a transferring device for transferring the toner image from the image retaining surface at a transfer section to a recording sheet;

a conveyor for conveying the recording sheet to the transfer section on the transferring device;

a cleaner for cleaning residual toner on the image retaining surface;

a holder for holding the image retainer, the charger, the plurality of developing devices and the cleaner in one body;

a housing;

a support for supporting the holder dismountably in the housing so that the holder is drawable out from a first position at which the holder is set in the housing to a second position at which jam disposition is conducted, wherein the holder is drawable out of the housing in a direction parallel to a recording sheet-conveying direction of the conveyor; and a member arranged to cover the image retaining surface at the transfer section when the holder is at the second position; and wherein the housing includes an opening therein and a cover member to at least one of open and close the opening, and the transferring device is associated with a mechanism that is movable interlockingly with the cover member so that the transferring device is moved in a direction away from the transfer section on the holder when the cover member opens the opening.

20. The apparatus according to claim 19, wherein the housing has an opening through which the holder is further drawable out from the second position to an outside of the housing.

21. A color image forming apparatus, comprising:

an image retainer having an image retaining surface on which a color toner image is retained;

a charger for charging the image retaining surface;

an exposure device for forming a latent image on the charged image retaining surface;

a plurality of developing devices for developing the latent image on the image retaining surface so as to form a toner image;

a transferring device for transferring the toner image from the image retaining surface at a transfer section to a recording sheet;

a conveyor for conveying the recording sheet to the transfer section on the transferring device;

a cleaner for cleaning residual toner on the image retaining surface;

a holder for holding the image retainer, the charger, the plurality of developing devices and the cleaner in one body;

a housing;

a support for supporting the holder dismountably in the housing so that the holder is drawable out from a first position at which the holder is set in the housing to a second position at which jam disposition is conducted, wherein the holder is drawable out of the housing in a direction parallel to a recording sheet-conveying direction of the conveyor; and a construction member arranged to cover the image retaining surface at the transfer section when the holder is at the second position; and wherein the housing includes an opening therein and a cover member to at least one of open and close the opening, and the image retainer is associated with a mechanism that is movable interlockingly with the cover member so that the image retainer is moved in a direction away from the transfer section on the holder when the cover member opens the opening.

22. The apparatus according to claim 21, wherein the housing has an opening through which the holder is further drawable out from the second position to an outside of the housing.

23. A color image forming apparatus, comprising:

an image retainer having an image retaining surface on which a color toner image is retained;

a charger for charging the image retaining surface;

an exposure device for forming a latent image on the charged image retaining surface;

a plurality of developing devices for developing the latent image on the image retaining surface so as to form a toner image;

a transferring device for transferring the toner image from the image retaining surface at a transfer section to a recording sheet;

a conveyor for conveying the recording sheet to the transfer section on the transferring device;

a cleaner for cleaning residual toner on the image retaining surface;

a holder for holding the image retainer, the charger, the plurality of developing devices and the cleaner in one body;

a housing;

a support for supporting the holder dismountably in the housing so that the holder is drawn out from a first position on which the holder is set so as to form a color image in the housing to a second position on which jam disposition is conducted; and a construction member forming a part of the housing, the construction member not being mounted on the holder, and the construction member being arranged to cover a part of the image retaining surface at the transfer section on the image retainer when the holder is placed at the second position.

24. The apparatus of claim 23, wherein:

the housing has an opening through which the holder is drawn out to an outside of the housing, so that when the holder is drawn out to the second position, at least a part of the holder is drawn out through the opening to the outside of the housing;

the housing comprises a side cover to cover the opening; and the side cover comprises the construction member to cover the part of the image retaining surface when the holder is located at the second position.

25. The apparatus of claim 24, wherein the side cover comprises a manual feed tray.

* * * * *